US005517285A

United States Patent [19]

Nomura et al.

[11] Patent Number: 5,517,285

[45] Date of Patent: May 14, 1996

[54] DEVELOPING APPARATUS IN WHICH THE DEVELOPER CARTRIDGE OR THE TONER CARTRIDGE IS MOUNTABLE

[75] Inventors: Susumu Nomura; Kozo Matsuyama, both of Yokohama, Japan

[73] Assignee: Kabushiki Kaisha Toshiba, Kawasaki, Japan

[21] Appl. No.: 274,283

[22] Filed: Jul. 13, 1994

[30] Foreign Application Priority Data

Jul. 14, 1993 [JP] Japan ..... 5-174340

[51] Int. Cl.[6] ..... G03G 15/06

[52] U.S. Cl. ..... 355/245; 355/260

[58] Field of Search ..... 355/260, 245; 222/DIG. 1

[56] References Cited

U.S. PATENT DOCUMENTS

| | | | |
|---|---|---|---|
| 4,561,759 | 12/1985 | Knott | 355/245 |
| 4,601,259 | 7/1986 | Yamashita | 118/658 |
| 4,742,370 | 5/1988 | Murakami et al. | 355/246 |
| 4,899,690 | 2/1990 | Hacknauer et al. | 118/653 |
| 5,017,966 | 5/1991 | Suga | 355/260 |
| 5,084,734 | 1/1992 | Yoshino et al. | 355/260 |
| 5,270,785 | 12/1993 | Kita et al. | 355/260 |
| 5,434,656 | 7/1995 | Nagaoka et al. | 355/260 |

FOREIGN PATENT DOCUMENTS

| | | |
|---|---|---|
| 0262640 | 4/1988 | European Pat. Off. . |
| 3326198 | 1/1985 | Germany . |
| 3428587 | 2/1985 | Germany . |
| 58-173783 | 10/1983 | Japan . |
| 61-194460 | 8/1986 | Japan . |
| 62-262079 | 11/1987 | Japan . |
| 63-137260 | 6/1988 | Japan . |
| 5-35096 | 2/1993 | Japan . |
| 6-102762 | 4/1994 | Japan . |

*Primary Examiner*—Nestor R. Ramirez
*Attorney, Agent, or Firm*—Foley & Lardner

[57] ABSTRACT

According to an image forming apparatus of the present invention, a developer filling opening is formed in an end of a casing which is provided with a developer-filled section, a holder section is arranged round the developer filling opening to hold a developer cartridge, guides are arranged adjacent to the developer cartridge holder section to guide the developer cartridge to the developer cartridge holder section when it is inserted into a developing unit from one side thereof, and the developer cartridge is attached to the developer cartridge holder section, when the developer-filled section with developer D in the developer cartridge, said developer consisting of toner T and carrier C mixed at a predetermined rate. The filling of developer or toner can be therefore more easily and quickly achieved without detaching the developing unit from the image forming apparatus. In addition, the developer and toner cartridges can be more easily and quickly attached to the developing unit from one side thereof when viewed in the horizontal direction.

7 Claims, 15 Drawing Sheets

DEVELOPING APPARATUS IN WHICH THE DEVELOPER CARTRIDGE OR THE TONER CARTRIDGE IS MOUNTABLE

BACKGROUND OF THE INVENTION

1. Field of the Invention

The present invention relates to an image forming apparatus such as the electrophotographic copying machine and the electronic printer and, more particularly, it relates to an image forming apparatus provided with a developing unit for developing an electrostatic latent image on an image carrier with two-component developer consisting of toner and carrier.

2. Description of the Related Art

Conventionally, the image forming apparatus of this type is used in such a way that a developing unit which has been stored, previously filling it with developer consisting of toner and carrier mixed at a predetermined rate, is prepared and that it is set in the image forming apparatus. According to this system, however, toner becomes hardened during the storage of the developing unit. Or toner becomes deteriorated when developer is filled in the developing unit for a long time.

Recently, therefore, a developer is filled in the empty developing unit just before it is used. Some typical examples of this system are known. In a typical one, a top cover is removed from the developing unit after it is detached from the image forming apparatus, and two-component developer mixed at an appropriate rate, is filled from a bottle into the developing unit, and then the developing unit is set in the image forming apparatus. In another system, a developer-filled cartridge is set in a toner cartridge setting opening of the empty developing unit in the image forming apparatus and developer is filled from the toner cartridge into the empty developing unit in the same manner as toner is added to the unit under normal operation.

In the former system where the filling of developer is made by the bottle, however, developer must be filled in the developing unit after it is detached from the image forming apparatus and the top cap is removed from it. This filling operation is quite troublesome. In the latter system where the filling of developer is made in the same manner as the adding of toner, it takes too long to fill a large amount of developer into the developing unit, because the filling of toner allows a little and certain amount of toner to be added from the toner cartridge to the developing unit at a predetermined timing.

SUMMARY OF THE INVENTION

The object of the present invention is therefore to provide an image forming apparatus capable of more easily, quickly and reliably filling developer into the developing unit without detaching the unit from the image forming apparatus.

According to the present invention, there can be provided an image forming apparatus wherein a developer, including a toner and a carrier, is charged from a developer cartridge and a replenishment toner is supplied from a toner cartridge after charging of the developer, comprising: developer receiving means for receiving the developer charged from the developer cartridge; a first opening section, provided on the developer receiving means and having a first opening, for allowing the developer to be received into the developer receiving means from the developer cartridge; first supporting means for detachably supporting the developer cartridge so as to set the charge port of the developer cartridge on the first opening section; a second opening section, provided on the developer receiving means and having a second opening, for allowing the toner to be received into the developer receiving means from the toner cartridge; second supporting means for detachably supporting the toner cartridge so as to set the supply port of the toner cartridge on the second opening section; and covering means, pivotally mounted on the first opening section and rotated between first and second positions, for allowing the first opening to be opened and preventing the toner cartridge from being mounted on the second supporting means when the cover means is set in the first position, and for covering the first opening and allowing the toner cartridge to be mounted on the second supporting means when the cover means is set in the second position.

According to the present invention, there is also provided an apparatus for forming an image on an image carrier comprising: a developer cartridge, having a supply port, for receiving a developer including a toner and carrier; developing means for developing the image on the image carrier with the developer, the developing means including receiving means for receiving the developer and supplying means for supplying the developer to the image carrier from the receiving means, and the receiving means having an opening section for allowing the developer to be charged into the receiving means from the developer cartridge and supporting means for supporting the developer cartridge so as to set the supply port on the opening section; transferring means for transferring the developed image on the image carrier to a paper sheet; removing means for removing the toner, which still remains on the image carrier, from the image carrier after the developed image is transferred onto the paper sheet, the removing means including a discharge section through which the removed toner is discharged; and supporting means for supporting the developer cartridge so as to face the supply port of the developer cartridge to the discharge section.

According to the present invention, there is further provided a developer apparatus wherein a developer, including a toner and a carrier, is charged from a developer cartridge and a replenishment toner is supplied from a toner cartridge after charging of the developer, comprising: a developer housing for receiving and storing the developer supplied from the developer cartridge; a first inlet section, having a first opening and provided on the developer housing, for allowing the developer to be supplied from the developer cartridge to the developer housing; and a second inlet section, having a second opening and provided on the developer housing, for allowing the toner to be supplied from the toner cartridge.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

The image forming apparatus according to an embodiment of the present invention will be described with reference to the accompanying drawings.

Figure 1:
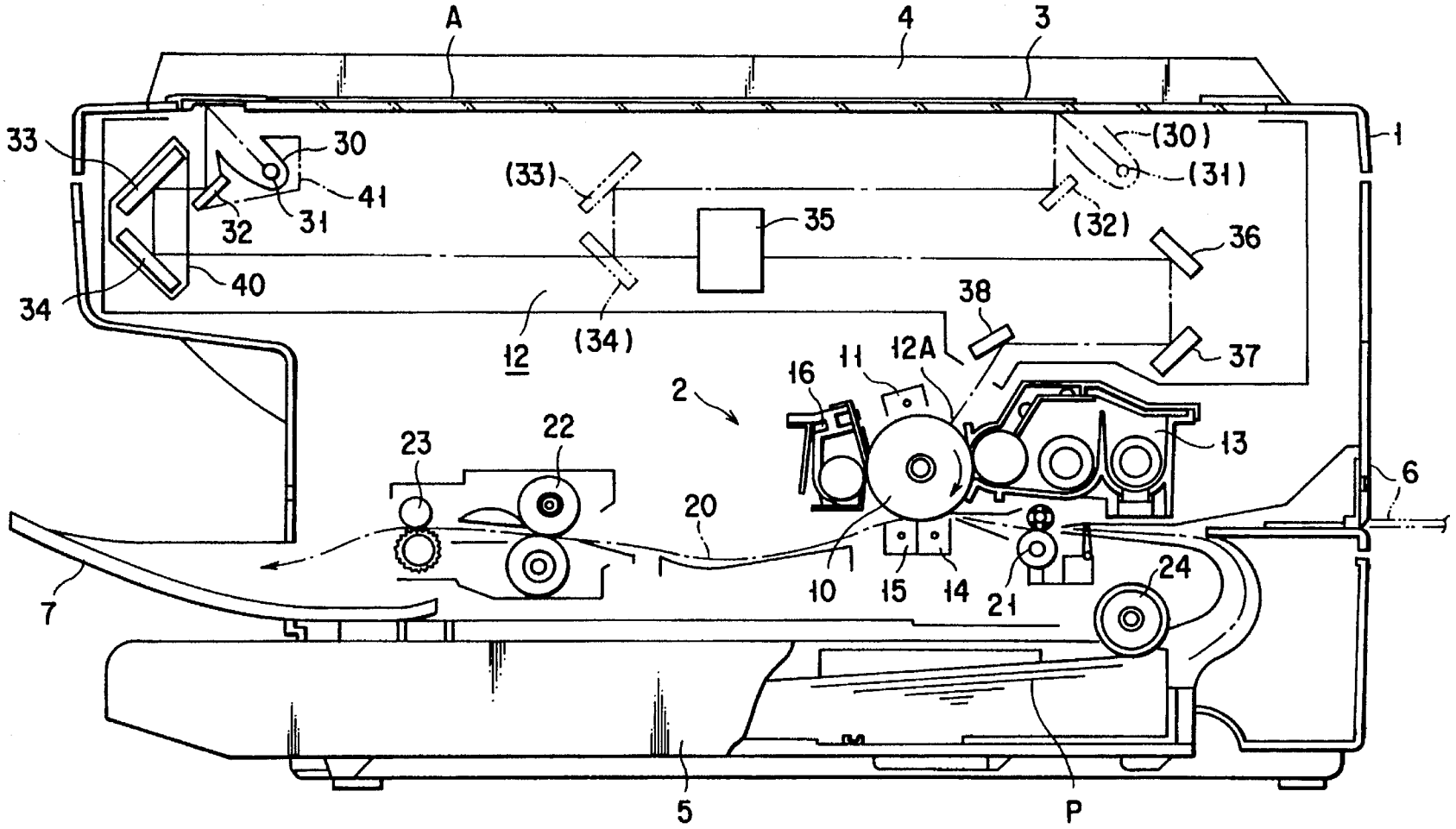
FIG. 1 shows the image forming apparatus according to an embodiment of the present invention.

FIG. 1 shows an electrophotographic copying machine which has been embodied as the image forming apparatus according to the present invention. In FIG. 1, reference numeral 1 represents an apparatus body, in which an image forming means 2 is housed to achieve an image forming process such as charging, exposing, developing, transferring and cleaning. Arranged on the top of the apparatus body 1 are a platen glass 3, which serves as an original-mounted table, and a platen cover 4, which serves to hold an original A on the platen glass 3. Further, an operation panel (not shown) is arranged on the top of the apparatus body 1 at the front rim portion thereof. A cassette 5 for supplying paper sheets P, on which images will be formed, to the image forming means 2 is arranged in the bottom of the apparatus body 1. In addition, a table 6 from which paper sheets P are supplied to the image forming means 2 by hand is attached to the right side of the apparatus body 1 and tray 7 into which image-fixed paper sheets P are discharged is attached to the left side thereof.

Figure 2:
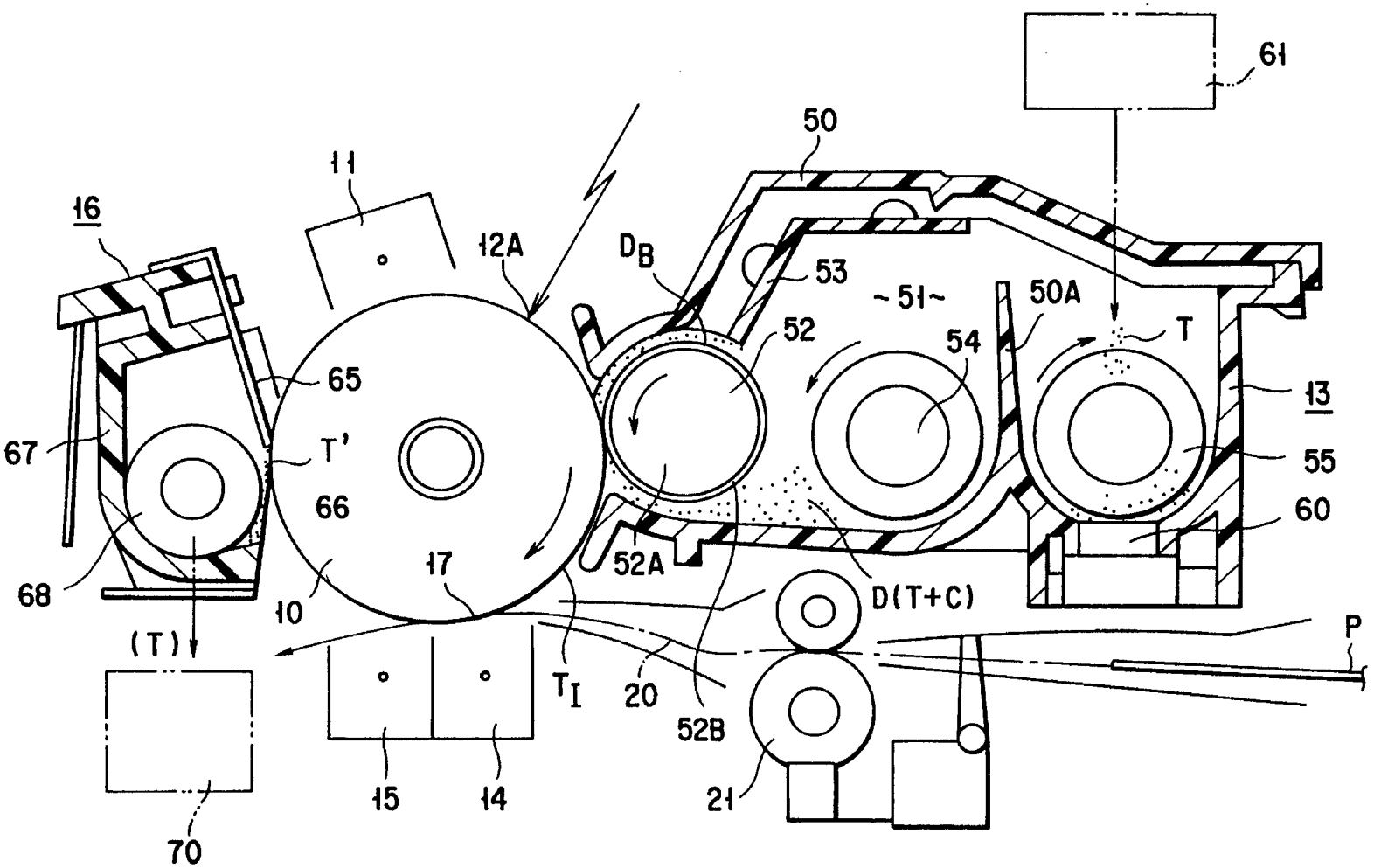
FIG. 2 shows a developing unit in the image forming apparatus.

As enlarged in FIG. 2, the image forming means 2 comprises a photosensitive drum 10 arranged in the center of the apparatus body 1 and serving as an image carrier, a unit 11 for charging the photosensitive drum 10, a unit 12 having an exposing section 12A for forming an electrostatic latent image on the photosensitive drum 10, a unit 13 for exposing the electrostatic latent image, a unit 14 for transferring the image, which has been developed visible, to a paper sheet, a unit 15 for taking the image-transferred paper sheet off from the photosensitive drum 10, and a unit 16 for cleaning the photosensitive drum 10. These units are arranged, in the above-mentioned order, around the photosensitive drum 10 in the rotating direction thereof.

Further, paper sheets conveying or feeding passage 20 is formed in the apparatus body 1 to convey paper sheets P, which have been supplied from the automatic supply cassette 5 or hand-supply table 6, to the tray 7 on the left side of the apparatus body 1 through an image transferring section 17 between the photosensitive drum 10 and the image transferring unit 14. A pair of aligning rollers 21 are arranged in the paper sheets conveying passage 20 upstream of the image transferring section 17. Front rims of paper sheets which are to be sent to the image transferring section 17 are aligned by these paired aligning rollers 21. A unit 22 for fixing the transferred-image on paper sheets and a pair of rollers 23 for discharging image-fixed paper sheets onto the tray 7 are also arranged in the paper sheets conveying passage 20 downstream of the image transferring section 17. Furthermore, a roller 24 is arranged adjacent to the cassette 5 to pick up paper sheets P one by one from the cassette 5 and send them to the paper sheets conveying passage 20.

The exposing unit 12 is arranged in the apparatus body 1 at the upper portion thereof. According to the exposing unit 12, the original A on the platen glass 3 is shot by an exposing lamp 31 which is enclosed by a reflector 30. Light thus reflected by the original A is then introduced to a lens 35 while being reflected by first, second and third mirrors 32, 33 and 34 in this order. After passing through the lens 35, it is further introduced to the photosensitive drum 10 while being reflected by fourth, fifth and sixth mirrors 36, 37 and 38 in this order.

The exposing lamp 31 and the first mirror 32 are attached to a first carriage 41 which can reciprocate along the underside of the platen glass 3. The second and third mirrors 33 and 34 are attached to a second carriage 40 which can reciprocate in the same direction at a speed half that of the first one 40. When the first and second carriages 40 and 41 are moved from left to right in FIG. 1, the original A on the platen glass 3 is optically scanned and an image on the original A is exposed on the photosensitive drum 10 through a slit.

When an image on the original A is to be formed on a sheet of paper P, the photosensitive drum 10 is rotated in the direction shown by an arrow in FIG. 1 and it is uniformly charged by the charging unit 11. The image on the original A is then slit-exposed on the uniformly-charged photosensitive drum 10 by the exposing unit 12 to form an electrostatic latent image on it. This electrostatic latent image is developed to a toner image by the developing unit 13.

Synchronizing with the toner image forming operation on the photosensitive drum 10, a paper sheet P is sent to the image transferring section 17 through paired aligning rollers 21 and the toner image on the photosensitive drum 10 is transferred on the paper sheet P by the transferring unit 14. The paper sheet P is then taken off from the photosensitive drum 10 by the take-off unit 15, while using AC corona discharge, and it is guided to the fixing unit 22 through the paper sheets conveying passage 20. The toner image is thus fixed on it by the fixing unit 22. It is then discharged onto the tray 7 by the paired rollers 23. On the other hand, the photosensitive drum 10 from which the toner image has been transferred is cleaned when toner remaining on the drum 10 is removed by the cleaning unit 16, and the drum 10 is thus made ready for the next copying operation.

The developing unit 13 has a structure as described below. As shown in FIG. 2, a developer storing section 51 in which two-component developer D is stored, is formed in a casing 50. The two-component developer D comprises a toner T which is pigment powder and carrier C which is magnetic powder, and the casing 50 serves as a developing unit body. Arranged in the casing 50 are a developing roller 52 facing the photosensitive drum 10 and carrying developer while causing a developer magnetic brush DB to continuously rub the photosensitive drum 10 as it rotates, a doctor blade 53 for defining the thickness of the magnetic brush DB formed on the surface of the developing roller 52, and first and second mixers 54, 55 for carrying developer D while stirring it in the developer storing section 51.

The developing roller 52 includes a magnetic roll 52A having plural magnetic poles (not shown) and serving as a magnetic power generator member, and a nonmagnetic developing sleeve 52B fitted onto the magnetic roll 52A and rotated. The developer magnetic brush DB of two-component developer D is formed on the surface of the developing sleeve 52B by the action of magnetic power generated from the magnetic poles of the magnetic roll 52A and it is carried as the developing sleeve 52B rotates. Two-component developer D stored in the developer storing section 51 is supplied from the mixer 54 to the developing roller 52 and carried counterclockwise on the developing roller 52 while forming the developer magnetic brush DB on it. The amount of two-component developer D carried is defined for this while to become constant by the doctor blade 53. The developer magnetic brush DB is sufficiently erected by the magnetic poles or their main poles in the magnetic roll 52A which face the photosensitive drum 10, and it rubs the photosensitive drum 10. Toner T thus electrostatically adheres to an electrostatic latent image on the photosensitive drum 10 to thereby form a toner image on it. When the developer magnetic brush DB passes through the developing position and reaches that portion of the magnetic roll 52A where no magnetic pole is arranged, it is released from the developing roller 52 and returned to the developer storing section 51.

The first and second mixers 54 and 55 are housed in the developer storing section 51 with a partition plate 50A interposed between them. The second mixer 55 feeds the developer to the developing roller 52 which rotates reversely to the second mixer 55, and the first mixer 54 returns the developer to the second mixer 55. Developer D is stirred and circulated in the developer storing section 51 to form a loop.

Figure 3:
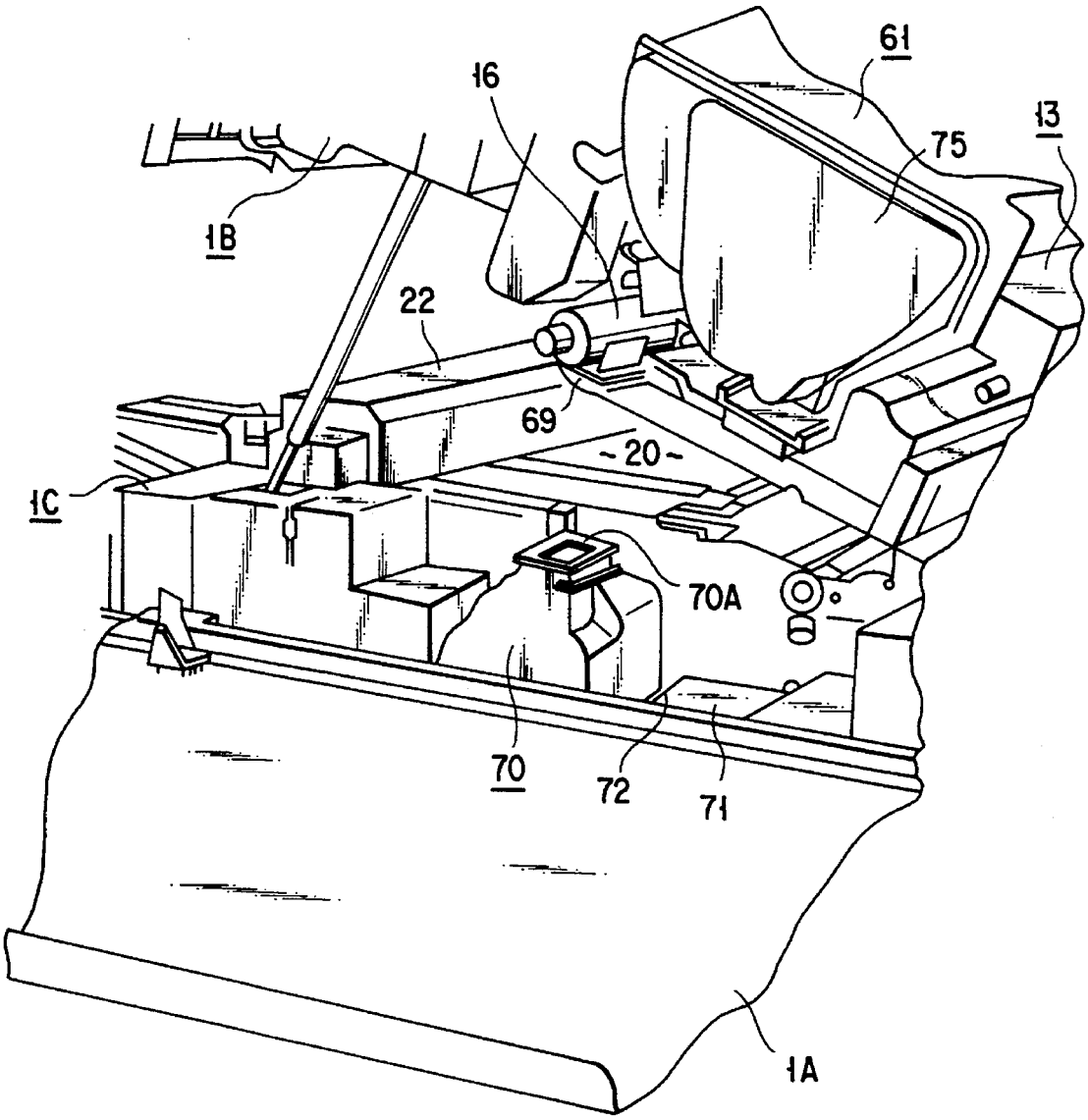
FIG. 3 is a perspective view showing a front side of the image forming apparatus when its upper unit is opened.

The toner density of developer D in the developer storing section 51 is detected by an auto toner sensor (ATS) 60 of the magnetic detector type arranged under the second mixer 55. When the toner density thus detected reaches a predetermined value, toner T is added from a toner adding unit 61 to the developer storing section 51. A toner cartridge 75 in which toner is stored is set in the toner adding unit 61, as shown in FIGS. 3 and 4, and toner T in it is added into the developer storing section 51 at a predetermined timing.

Figure 4:
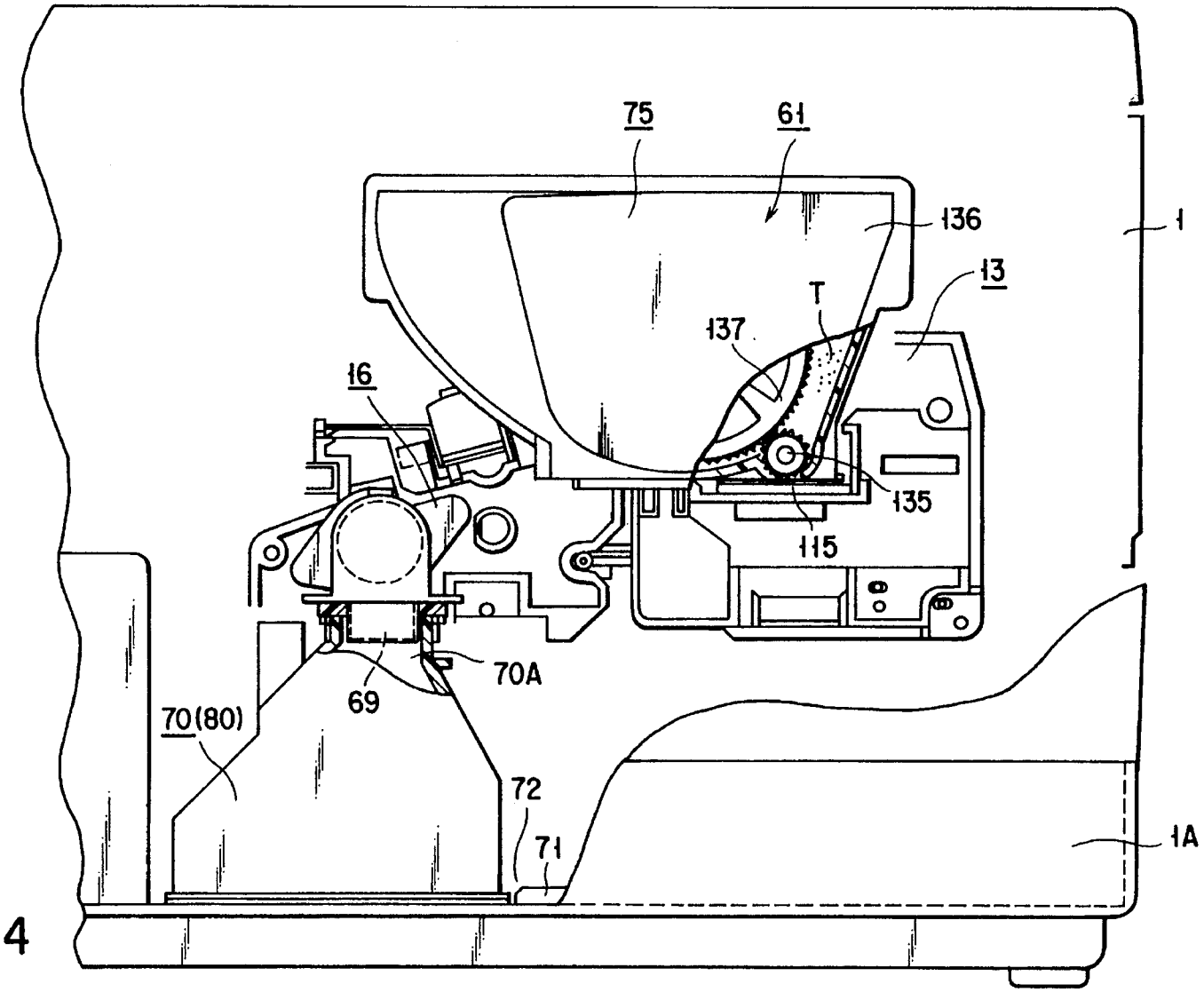
FIG. 4 is a front view showing the front side of the image forming apparatus when its upper unit is closed.

The toner cartridge 75 includes a cartridge body 136 in which toner T is stored, a toner adding auger 135, and a member 137 for stirring toner T while rotating together with the auger 135, as shown in FIG. 4.

A drive unit 100 (which will be described later in detail with reference to FIG. 9) is attached to the toner adding unit 61. It is engaged with a shaft of the auger 135 of the toner cartridge 75 to drive and rotate the auger 135. Toner T is added from the toner adding unit 61 to the second mixer 55 on the front side thereof and it is then carried to the rear side of the second mixer 55 while being stirred with developer D in the developer storing section 51. Developer D thus mixed is further carried from here to the first mixer 54 on the rear side thereof and while being stirred and carried by the first mixer 54, a part of it is supplied to the developing roller 52. After thus being carried to the front side of the first mixer 54 and passing through that position at which a part of it is supplied to the developing roller 52, it is collected and mixed with developer D, which is not supplied to the developing roller 52, by the first mixer 54. It is again carried to the front side of the first mixer 54 while being stirred, and then to the second mixer 55. It is thus circulated in the developing unit 13.

As shown in FIG. 2, the cleaning unit 16 scrapes remaining toner T' off from the surface of the photosensitive drum 10 by a cleaning blade 65. The photosensitive drum 10 is thus cleaned. At the same time, waste toner T' scraped off is collected into a case 67 by a recovery blade 66 and then carried by an auger 68 which is arranged on the bottom of the case 67. Waste toner T' thus carried to the front side of the auger 68 is discharged from a waste toner discharge section 69 shown in FIG. 3 into a collecting case 70. As shown in FIG. 3, the waste toner collecting case 70 is arranged at such a position in the apparatus body 1 that can be easily seen when the front cover 1A at the front side of the apparatus body 1 is opened. More specifically, it is detachably fitted in a recess 72 which is formed on an inner plate 71 arranged at the front side of the apparatus body 1.

When an upper unit 1B is swung and released from a lower unit 1C to open the paper sheets carrying passage 20 in the apparatus body 1, as shown in FIG. 3, the cleaning unit 16 incorporated into the upper unit 1B is separated from the waste toner collecting case 70 which is mounted on the inner plate 71 with its opening 70A kept upside. This makes it easier for the waste toner collecting case 70 to be exchanged with a new one. When the upper unit 1B is swung and closed onto the lower unit 1C, the waste toner discharge section 69 is fitted into the opening 70A of the waste toner collecting case 70. Waste toner T' can thus be prevented from leaking outside in the apparatus body 1.

Figure 5:
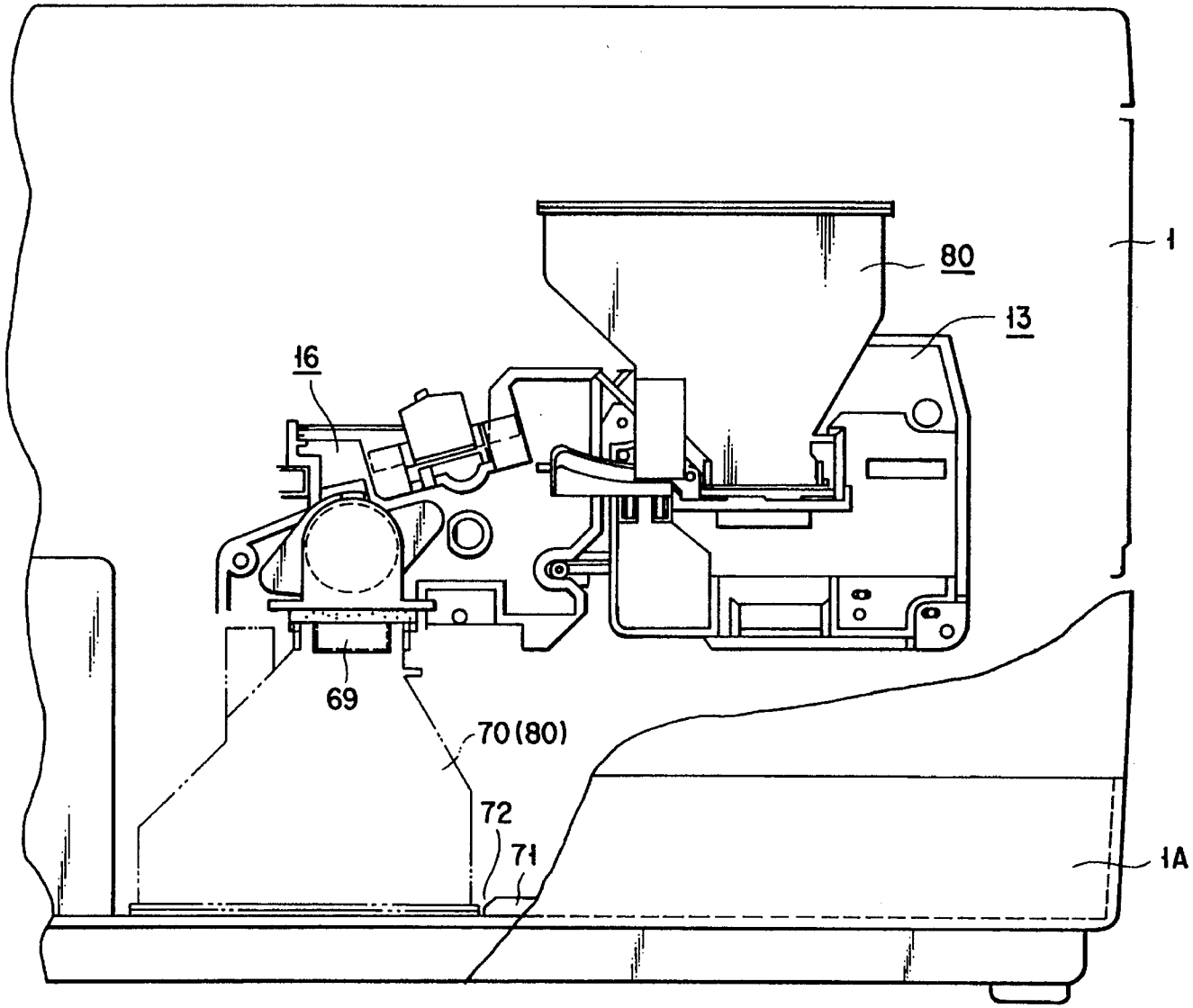
FIG. 5 shows a developer cartridge, which has been used up in the image forming apparatus, used again as a waste toner collecting case in it.

As shown in FIG. 5, a developer cartridge 80 can be set in the developing unit 13, instead of the toner cartridge 75 of the toner adding unit 61 (see FIGS. 3 and 4). As will be described later, two-component developer D comprising toner T and carrier C mixed at a predetermined rate can be filled from the developer cartridge 80 into the developer storing section 51. When all of developer D is thus filled in the developer storing section 51 in this manner, the empty cartridge 80 can be used as the waste toner collecting case 70 only by setting it upside down in the recess 72 on the inner plate 71.

Figure 6:
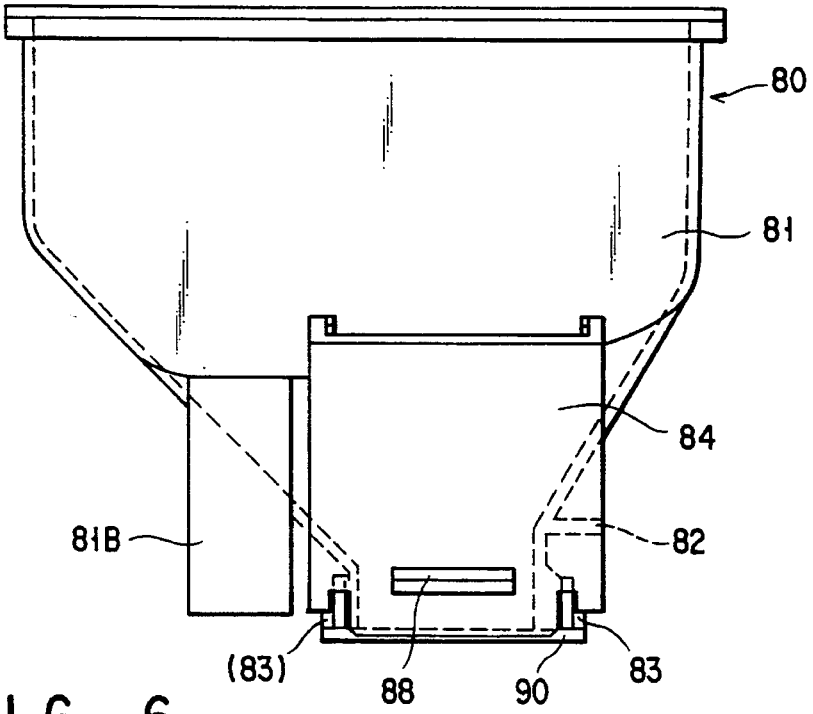
FIG. 6 is a front view showing the developer cartridge in the image forming apparatus.
Figure 7:
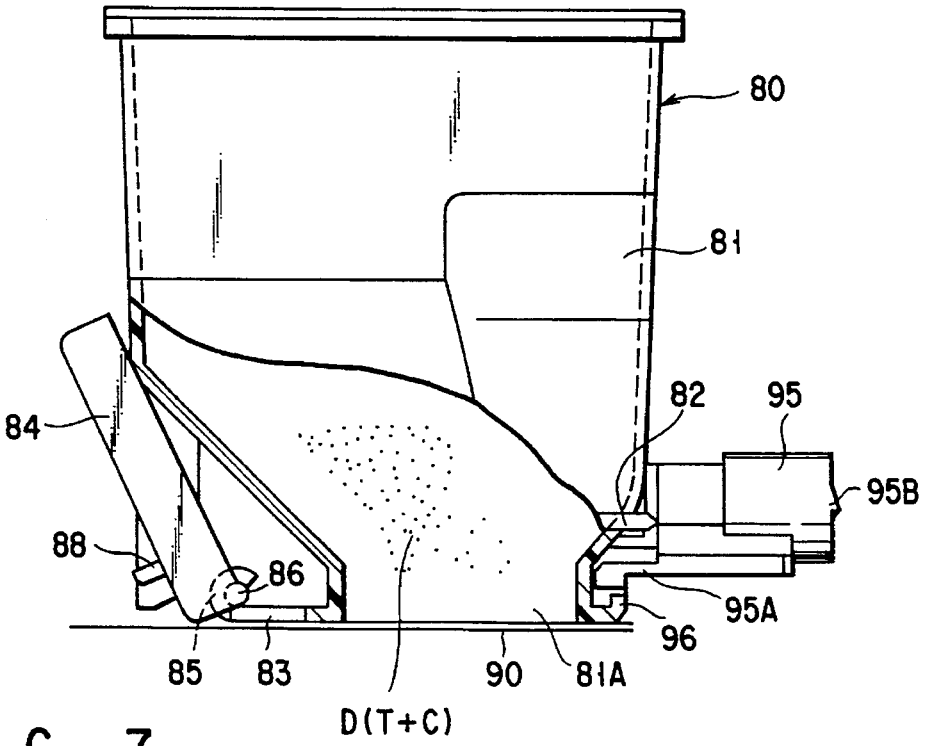
FIG. 7 is a side view showing the developer cartridge.
Figure 8:
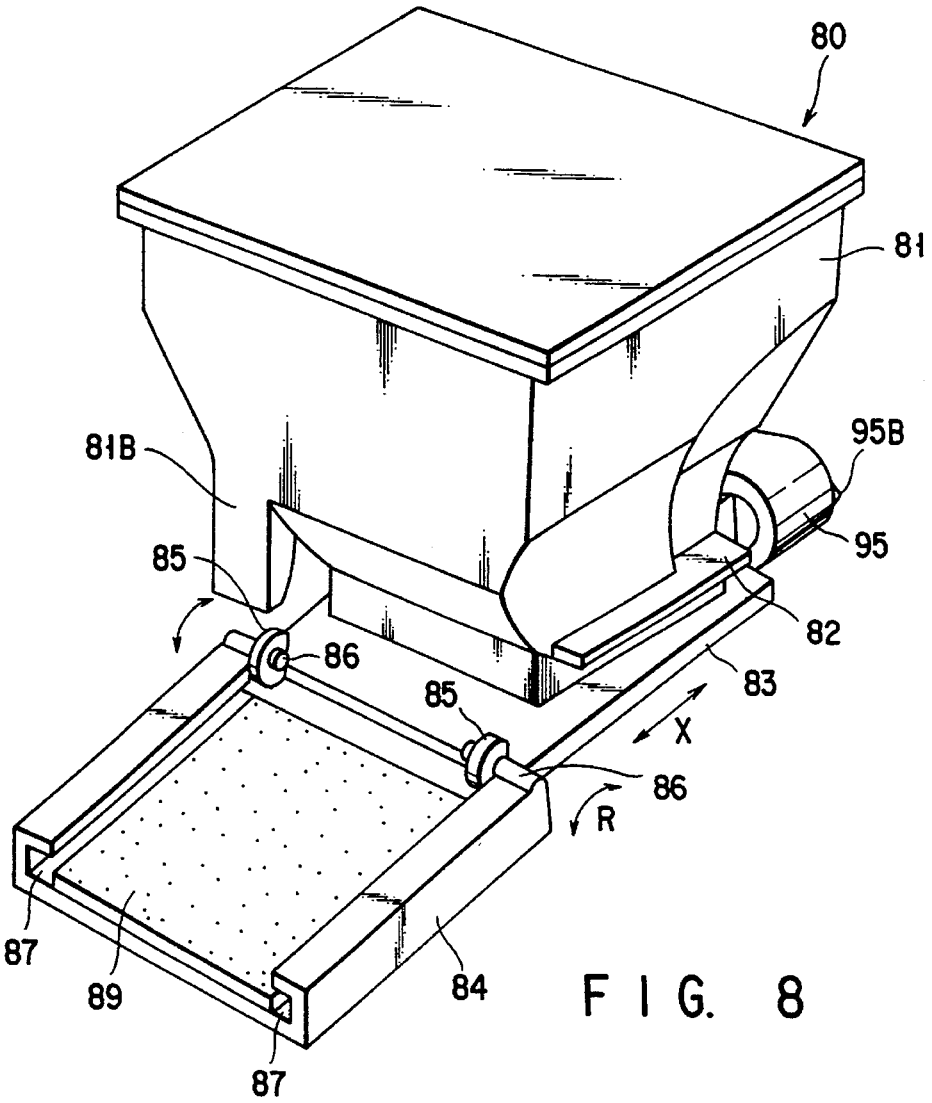
FIG. 8 is a perspective view showing the developer cartridge.

As shown in FIGS. 6, 7 and 8, the developer cartridge 80 includes a cartridge body 81 which is a combination of vertical planes and slopes so shaped as to enable developer D in it to easily drop through it. A horizontal guide 82 and shutter guides 83 are made integral to the cartridge body 81. The horizontal guide 82 guides the cartridge body 81 when the body 81 is set at a developer cartridge holder section 110 of the developing unit 13. A slide shutter 84 is also attached to the cartridge body 81 to open and close a developer feeding opening 81A of the body 81. When its grooves 87 are engaged with the shutter guides 83, the slide shutter 84 can be slid in a direction X and when its rods 86 are engaged with hooks 85 of the shutter guides 83, it can be swung in a direction R, as shown in FIG. 8.

A projection 88 is projected from the underside of the slide shutter 84. When the developer cartridge 80 is to be detached from the holder section 110, the projection 88 is engaged with the holder section 110 so that the slide shutter 84 can again slide along the shutter guides 83 to close the developer feeding opening 81A. This closing operation of the slide shutter 84 will be later described in detail. A sealing member 89 made by foaming material is bonded to the top of the slide shutter 84 to prevent developer D from being leaked between the shutter 84 and the opening 81A when the opening 81A is closed by the shutter 84.

Figure 9:
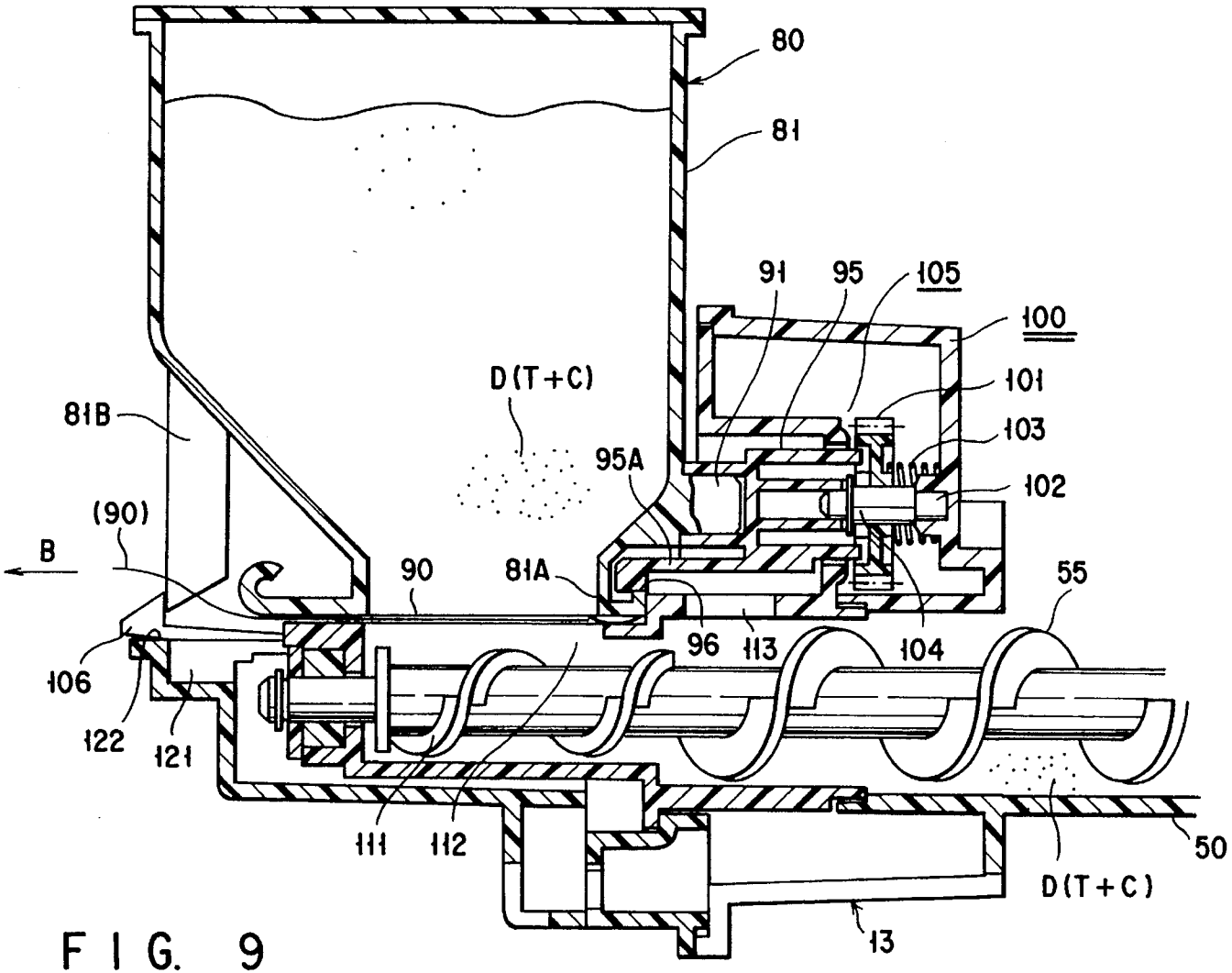
FIG. 9 is a sectional view showing the developer cartridge set in the image forming apparatus.

The developer feeding opening 81A is closed at first by a seal tape 90. Even if the slide shutter 84 should be moved to open the developer feeding opening 81A, therefore, developer D cannot be leaked through the opening 81A. As shown in FIG. 9, the seal tape 90 is folded when it keeps the opening 81A closed. It can be therefore removed from the opening 81A only by pulling its one end in a direction B after the developer cartridge 80 is set at the holder section 110.

Figure 10:
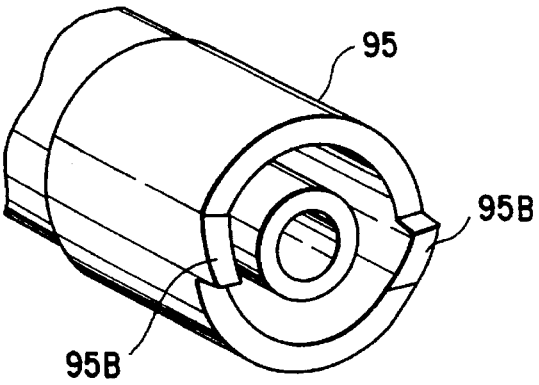
FIG. 10 is a perspective view showing the front end of a vibration generator member which is attached to the developer cartridge.
Figure 11:
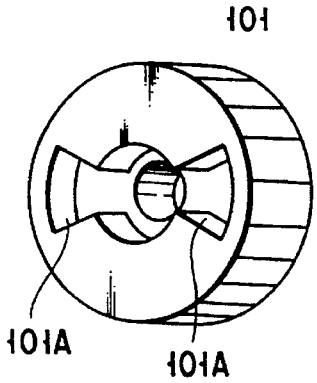
FIG. 11 is a perspective view showing a coupling gear at a toner adding member driving section.
Figure 12:
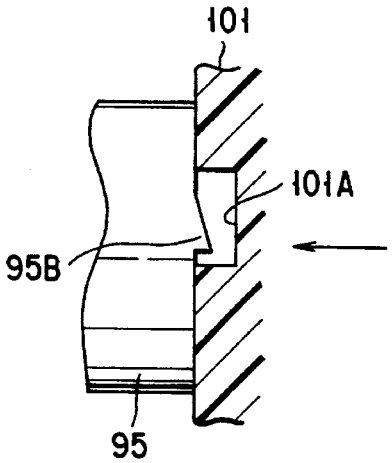
FIG. 12 shows the front claw of the vibration generator member fitted in a groove of the coupling gear.
Figure 13:
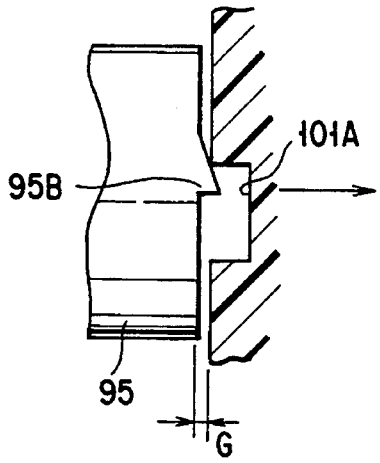
FIG. 13 shows the front claw of the vibration generator member now fitting into the groove of the coupling gear.

As shown in FIG. 9, a shaft 91 is projected from the front end face of the developer cartridge 80, extending in a direction in which the cartridge 80 is attached to the holder section 110. A vibration generator member 95 shown in FIG. 10 is fitted onto the shaft 91 to add vibration to the developer cartridge 80. When the vibration generator member 95 is attached to the shaft 91, its rotation stopper tongue 95A which stops it from rotating around the shaft 91 is struck against a support step 96 of the cartridge body 81 which also serves as a stopper for the shutter 84. A pair of claws 95B are formed on the front end face of the vibration generator member 95, as shown in FIG. 10, and when the developer cartridge 80 is attached to the toner adding unit 61, these claws 95B are combined with the drive mechanism 100 of the toner adding unit 61 to contact the end face of a rotating coupling gear 101. Vibration is thus added from the coupling gear 101 to the claws 95B, that is, to the developer cartridge 80. More specifically, the coupling gear 101 is attached to a rotating shaft 102 and urged toward a stop ring 104, which prevents the coupling gear 101 from coming out of the rotating shaft 102, by a compression spring 103. In short, it is urged to contact the claws 95B of the vibration generator member 95. On the other hand, drive power transmitting grooves 101A are formed in an end face of the coupling gear 101, as shown in FIG. 11. When the coupling gear 101 is rotated in the same manner as at the toner adding time, therefore, the claws 95B of the vibration generator member 95 are engaged with and disengaged from the grooves 101A of the coupling gear 101, so that the formation of a clearance G is repeated between the coupling gear 101 and the vibration generator member 95, as shown in FIGS. 12 and 13. When the state shown in FIG. 13 changes to the one shown in FIG. 12, the coupling gear 101 is severely pushed by the compression spring 103 to thereby collide against the vibration generator member 95. When this is repeated, therefore, vibration is added to the cartridge body 81. As apparent from the above, the vibration generator member 95, the coupling gear 101 and the compression spring 103 form a vibration adding mechanism 105 which adds vibration to the developer cartridge 80.

As shown in FIG. 9, a hook 106 is arranged adjacent to the cartridge holder section 110 and the front end of a support arm 81B formed integral to the cartridge body 81 is hooked by the hook 106. The developer cartridge 80 can be thus prevented from coming out of the holder section 110. Even if vibration is added to the developer cartridge 80 at the holder section 110 through the vibration adding mechanism 105, therefore, the developer cartridge 80 can be fixed at its predetermined position in the holder section 110.

Figure 14:
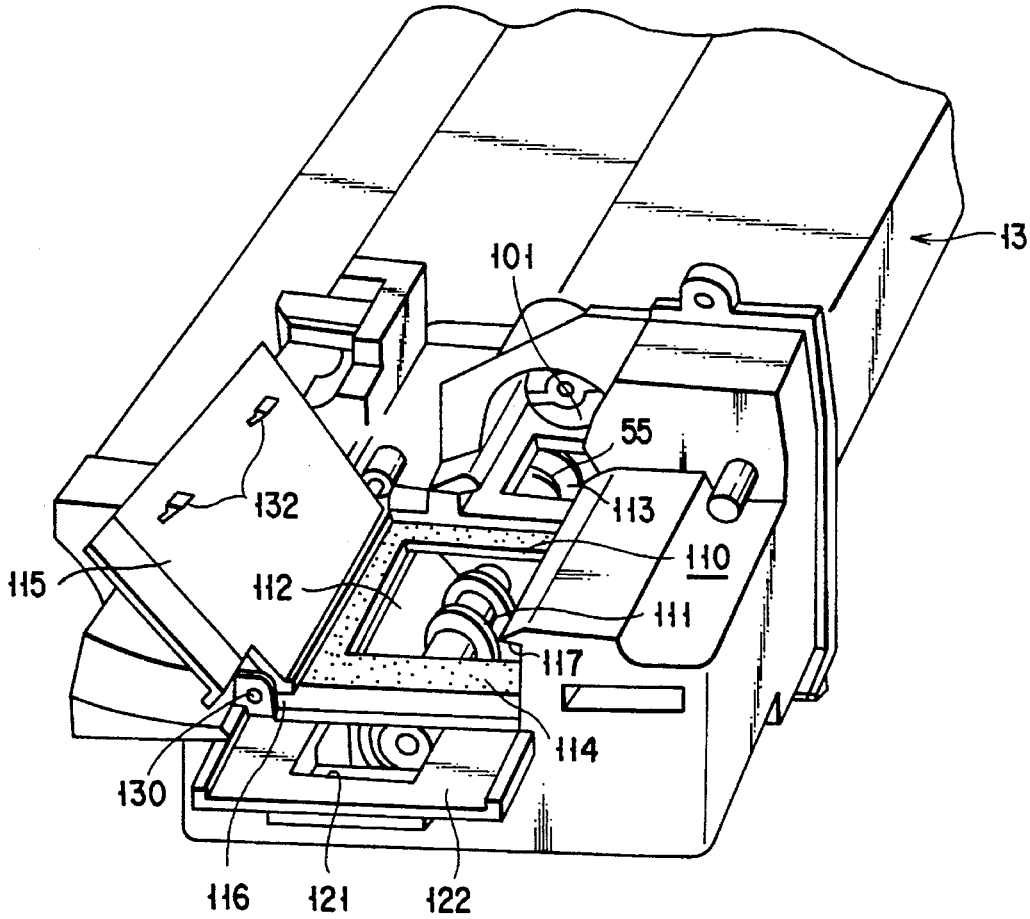
FIG. 14 is a perspective view showing a front side of the developing unit.

Referring to FIGS. 9, 14, 15 and 16, it will be described how the front side of the developing unit 13 is made. As shown in FIG. 14, a developer filling opening 112 through which developer D is fed from the developer cartridge 80 is formed in the top of the developing unit 13, and the second mixer 55 for stirring and carrying developer extends from a developer-filled chamber under the opening 112 into the developer storing section 51 of the developing unit 13. In short, developer D is dropped on the second mixer 55 in the developer-filled chamber through the opening 112 and stirred and carried by the mixer 55. For the sake of convenience, that portion of the second mixer 55 which extends from the developer storing section 51 under the opening 112 will be hereinafter referred to as a mixer extended portion 111.

Further, a toner adding opening 113 is formed adjacent to the developer filling opening 112 of the developing unit 13 and toner T is added from the toner cartridge 75, which is communicated with the developer filled chamber, into the developing unit 13. The developer filling opening 112 has a relatively large diameter to allow the developer to be quickly filled through it, but the toner adding opening 113 has a relatively small diameter because it is enough for the toner adding opening 113 to enable the amount of toner only added to pass through it. When the toner cartridge 75 is set in the developing unit 13, toner T is dropped on the second mixer 55 in the developer-filled chamber through the toner adding opening 113 and stirred and carried by the second mixer 55.

Figure 15:
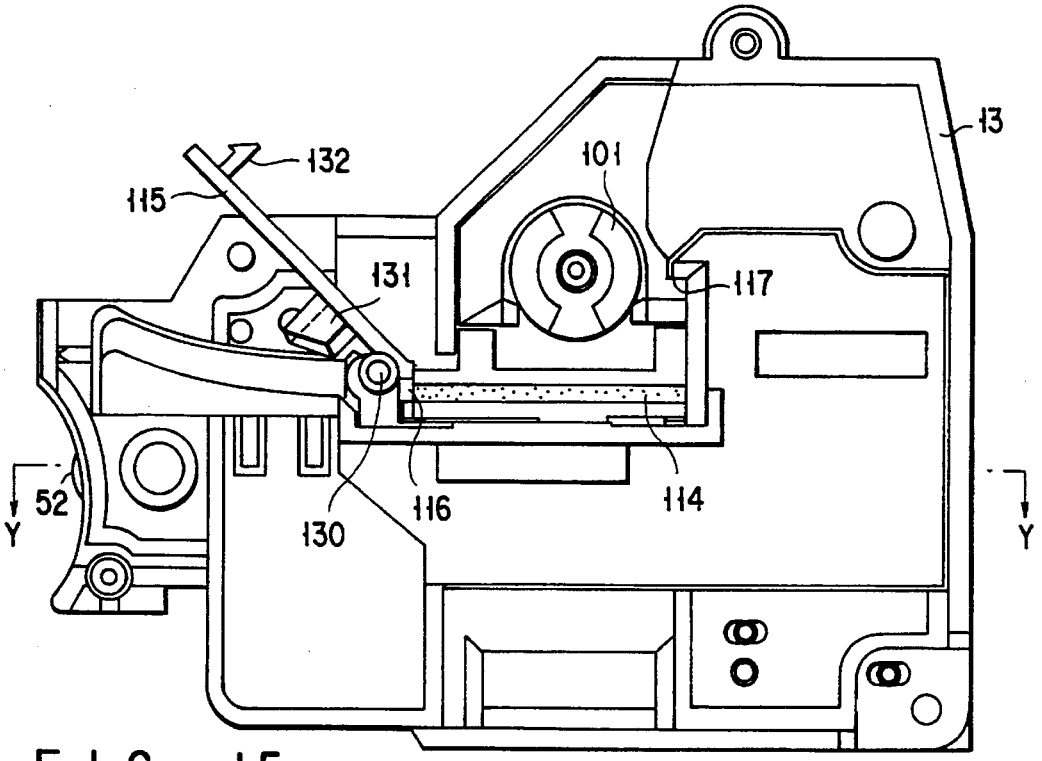
FIG. 15 is a front view showing the front side of the developing unit.

As shown in FIGS. 14 and 15, a resilient member 114 is bonded to the top of the rim portion along the developer filling opening 112 to prevent the leakage of developer D. In addition, a cap 115 is freely swingably arranged adjacent to the developer filling opening 112 and along one side of the rim portion to close and open the developer filling opening 112.

As shown in FIGS. 14 and 15 in which the cap 115 is kept open, the lower end portion of the tilted cap 115 has an insertion guide 116 which allows the rim portion of the left shutter guide 83 of the developer cartridge 80 to be slid along it. On the other hand, another insertion guide 117 is provided at the cartridge holder section 110, opposing to the guide 116 and extending to allow the top of the horizontal guide 82 of the developer cartridge 80 to be slid along it. When the developer cartridge 80 is to be set in the developing unit 13, therefore, the left shutter guide 83 and the horizontal guide 82 of the developer cartridge 80 are guided along the insertion guides 116 and 117 and the developer feeding opening 81A of the developer cartridge 80 is positioned just above the developer filling opening 112.

Figure 17:
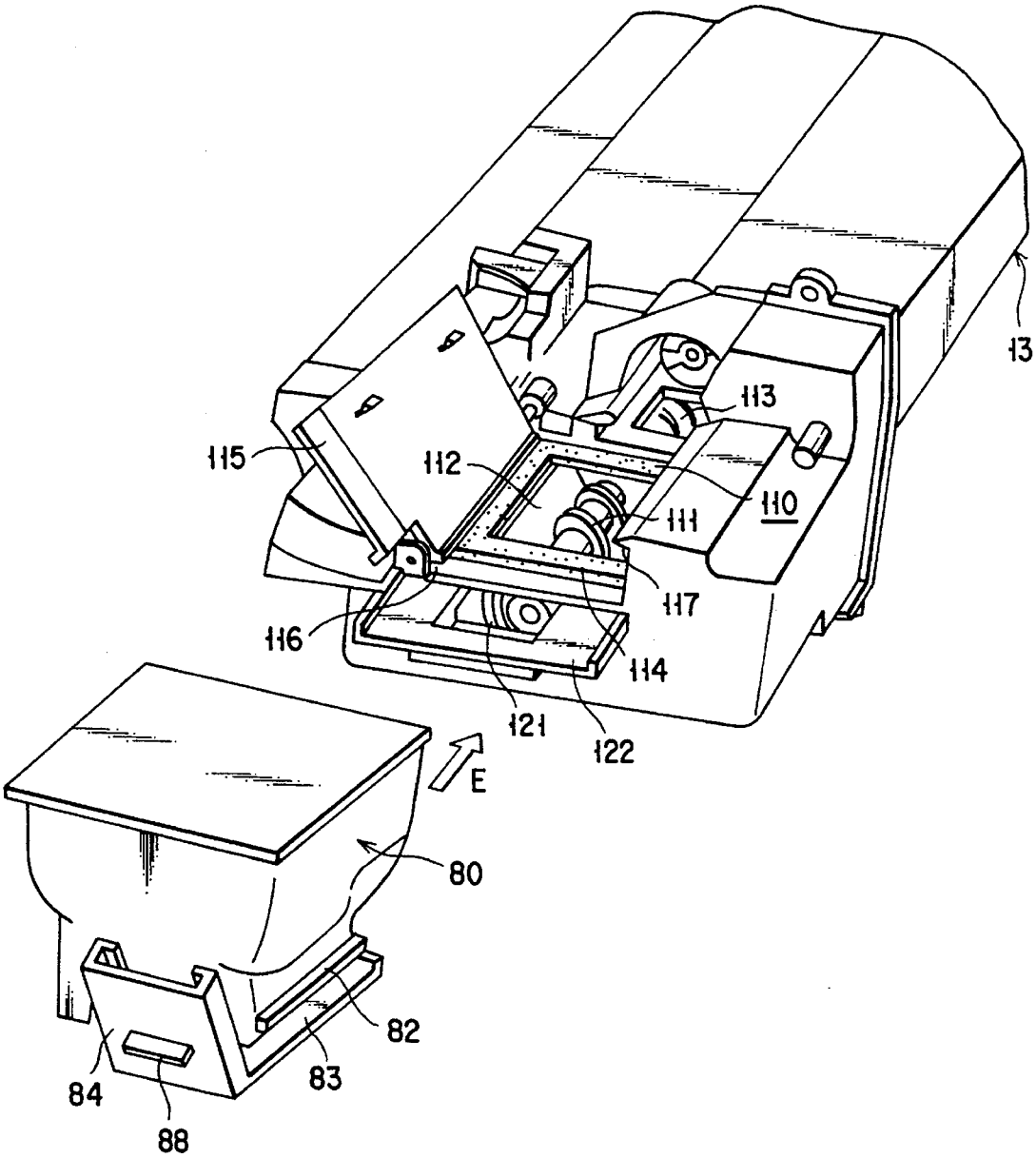
FIG. 17 shows how the developer cartridge is set to a holder section in the developing unit.

When the developer cartridge 80 is to be set at the developer cartridge holder section 110, the cap 115 is kept open, that is, the developer filling opening 112 is kept open, as shown in FIG. 17. The left shutter guide 83 of the developer cartridge 80 is then put along the insertion guide 116 while the horizontal guide 82 thereof along the insertion guide 117, and the developer cartridge 80 is pushed into the holder section 110 in a direction E. When the developer filling opening 112 is kept closed by the cap 115, the developer cartridge 80 cannot be set at the holder section 110. In other words, it cannot be set at the holder section 110 when its left shutter and horizontal guides 82 and 83 are not allowed to slide along the insertion guides 116 and 117.

Figure 18:
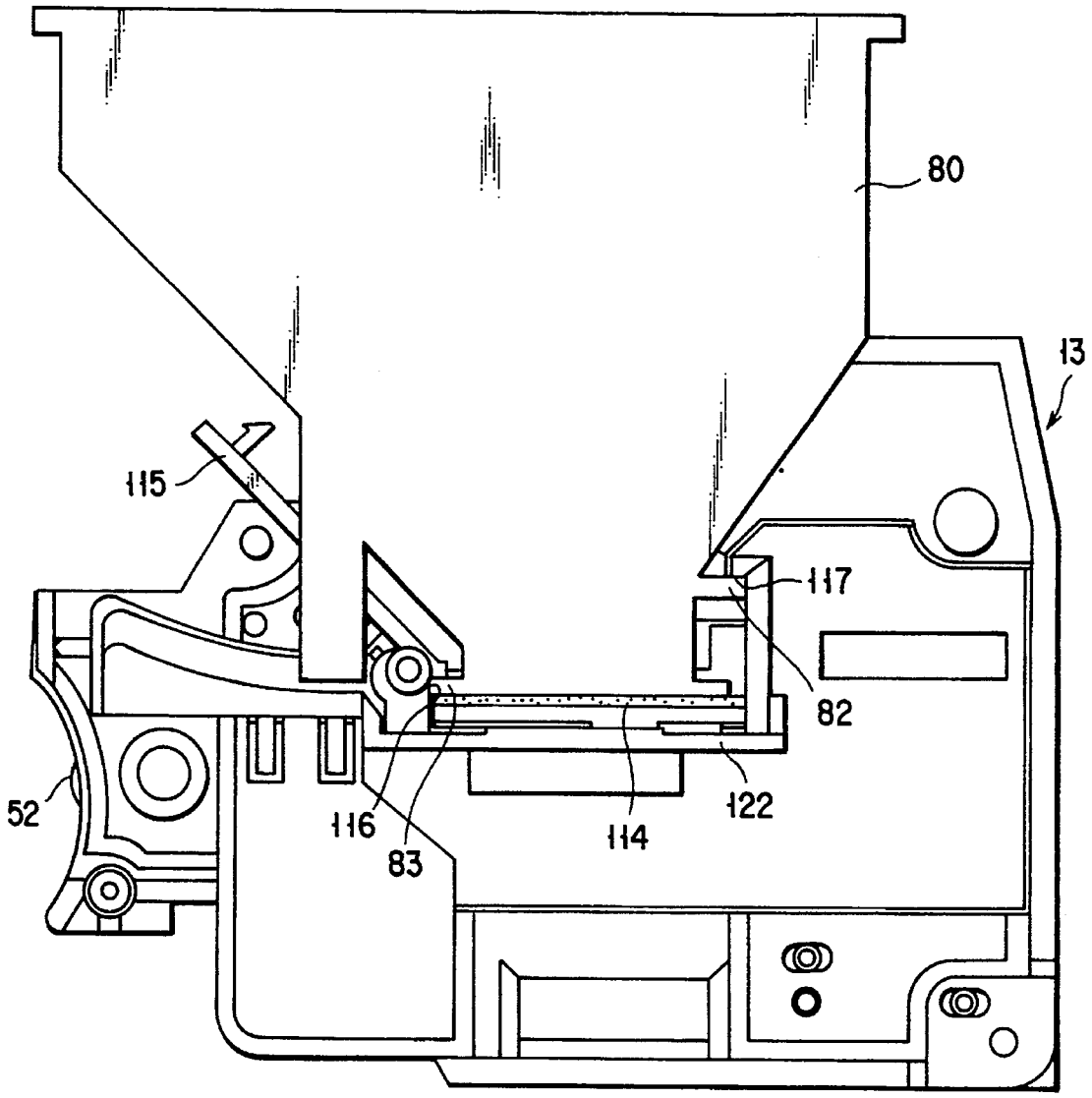
FIG. 18 is a front view showing the developer cartridge set to the holder section of the developing unit.

When the developer cartridge 80 is set at the cartridge holder section 110, the rim portion of its left shutter guide 83 and the top of its horizontal guide 82 are surely contacted with the insertion guides 116 and 117, so that they can be positioned at their predetermined place, as shown in FIG. 18. In addition, the resilient member 114 bonded to the top of the rim portion along the developer filling opening 112 is a little pressed by them to thereby prevent the leakage of developer D.

Figure 16:
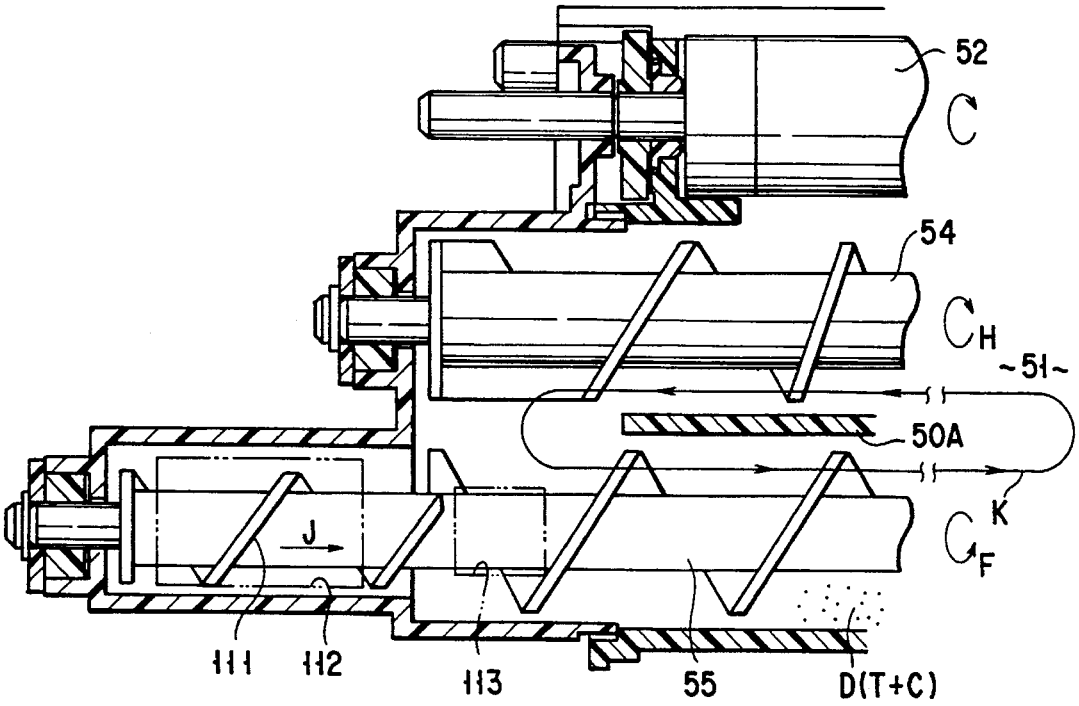
FIG. 16 is a sectional view taken along a line Y—Y in FIG. 15.
Figure 19:
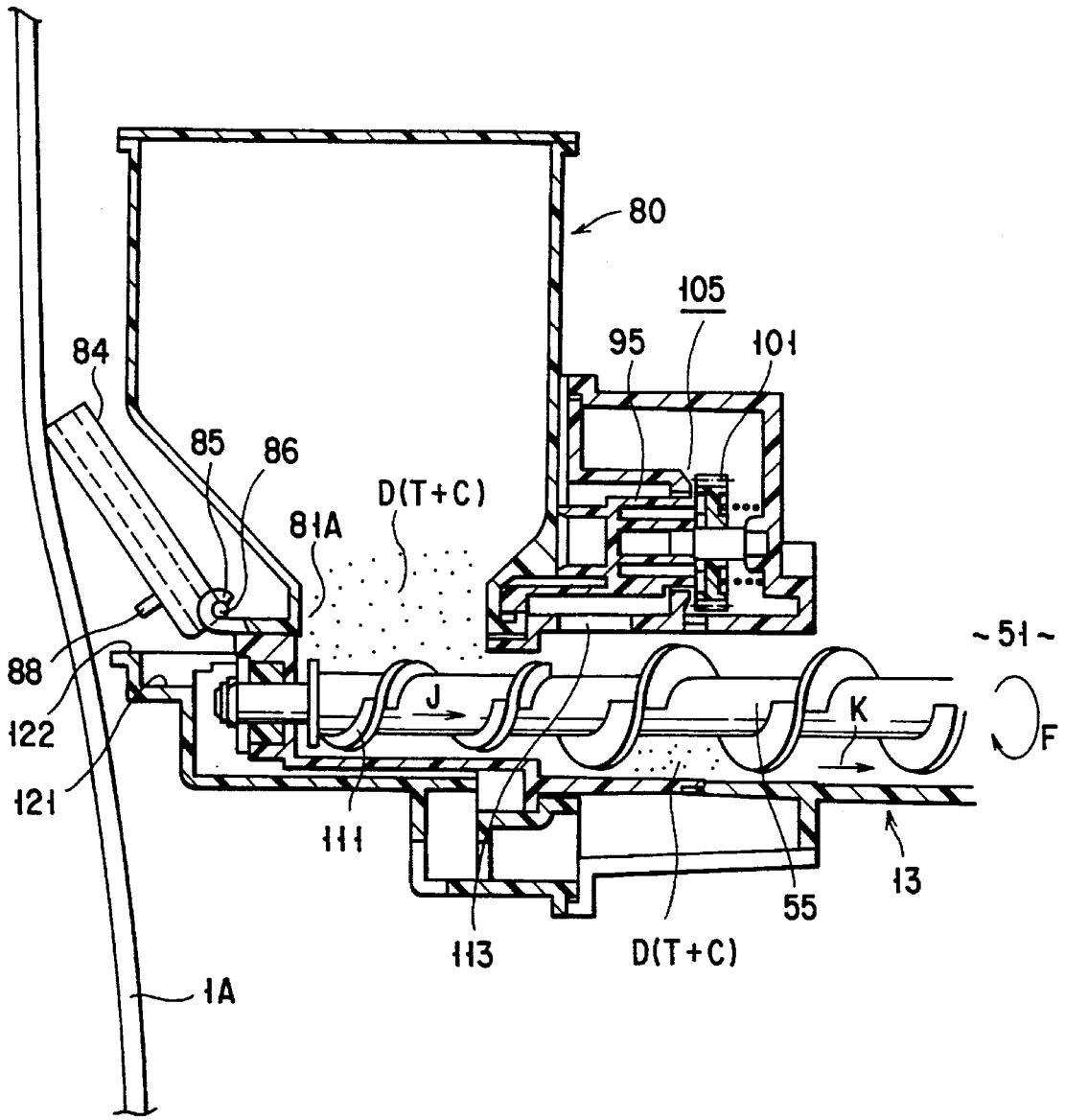
FIG. 19 shows how developer is added from the developer cartridge into the image forming apparatus.

When the developing unit 13 is used for the first time, two-component developer D comprising toner T and carrier C mixed at the predetermined rate is filled in the developer-filled section 51 of the developing unit 13 as follows:

As described above, the developer cartridge 80 is set at the cartridge holder section 110. One end of the seal tape 90 which closes the developer feeding opening 81A of the cartridge 80 is pulled in the direction B, as shown in FIG. 9, and it is removed from the opening 81A accordingly. The opening 81A is thus opened. Therefore, developer D in the cartridge body 81 is dropped on the extended portion of the second mixer 55 through the developer filling opening 112. The front cover 1A is then closed, as shown in FIG. 19, and the second developer feeding mixer 55 and the first developer returning mixer 54 in the developing unit 13 are rotated. As shown in FIG. 16, they are rotated in directions F and H to carry developer D in reverse directions with the partition plate 50A interposed between them.

Developer D dropped through the developer filling opening 112 is thus quickly carried to the developer-filled section 51 in a direction J shown in FIGS. 16 and 19 by the extended portion 111 of the second mixer 55. It is circulated to form a loop in a direction K, as shown in FIG. 16, in the developer-filled section 51 by the action of the second and first developer feeding and returning mixers 55 and 55, while being stirred. It can be thus uniformly filled in the developer-filled section 51.

The second developer feeding mixer 55 is rotated in a certain direction at all times. No developer is therefore fed backward to the extended portion 111 of the mixer 55 during the usual copying operation.

On the other hand, vibration is added to the developer cartridge 80 for this while by the vibration adding mechanism 105, as described above. Therefore, developer D can be dropped on the second mixer 55 without causing it to be Jammed in the developer feeding opening 81A. In addition, it can be prevented from adhering to the inner face of the developer cartridge 80.

When the above-described developer filling system according to the present invention is employed, it takes about 40 seconds to finish the developer filling operation. It is by far shorter than in the conventional cases.

When the image forming apparatus is uncased and power is applied to it, the output of the toner auto-sensor 60 is adjusted. When the developer filling system of the present invention is used, this adjusting operation is made after considering the developer filling time and the developer stirring time after it is filled. If the amount of developer filled is not enough or developer is not filled at all, therefore, the output value of the toner auto-sensor 60 will become different from usual one at the above-mentioned adjusting time. This can be thus displayed on a display (not shown) of the operation panel to let the operator know about it.

Until the developer filling operation is finished, the slide shutter 84 for the developer cartridge 80 are kept engaged with the arc-like hooks 85 projected from the shutter guides 83 for the developer cartridge 80 and it is also kept pushed up by the front cover 1A at the front side of the apparatus, as shown in FIG. 19.

When the filling of developer D from the developer cartridge 80 is finished, the empty cartridge 80 is detached from the cartridge holder section 110 and the cap 115 is closed. A toner cartridge 75 is set instead of this developer cartridge 80, as shown in FIG. 4, and after the slide shutter 84 and the vibration generator member 95 are detached from the empty developer cartridge 80, it is set upside down in the recess 72 on the inner plate 71. It can be thus used as the waste toner collecting case 70.

Figure 20:
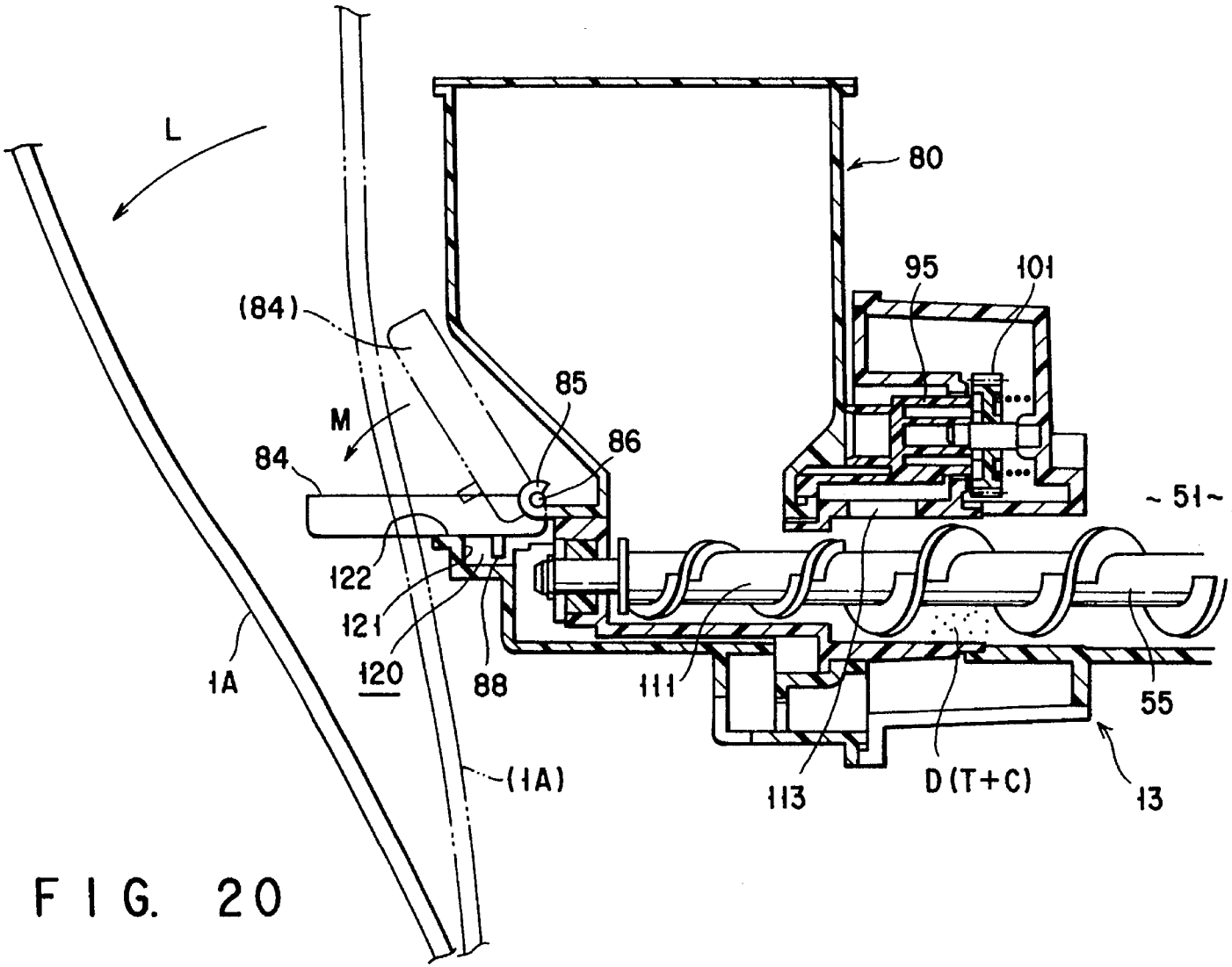
FIG. 20 shows a front cover a little opened to allow the developer cartridge, whose developer adding is finished, to be detached from the developing unit.
Figure 21:
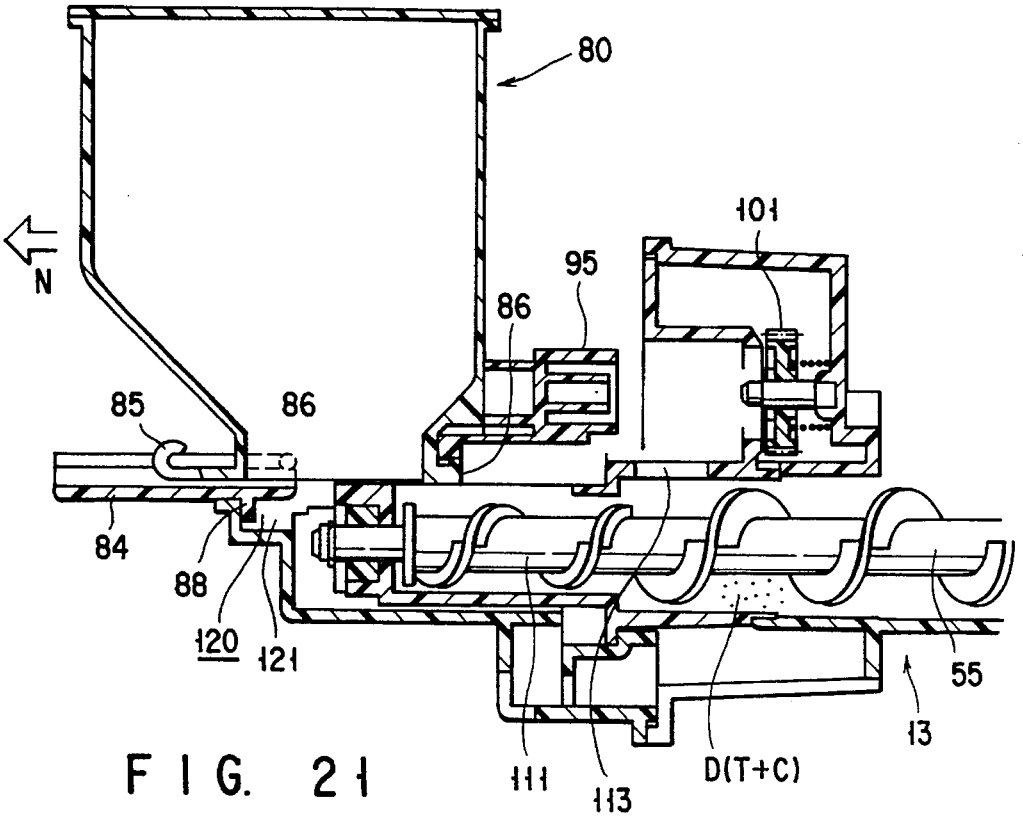
FIG. 21 shows the developer cartridge a little pulled out of the holder section in the developing unit.

The developer cartridge 80 is detached from the developing unit 13, as described above, after the developer filling operation is finished. However, a little developer D remaining in the cartridge 80 may fall this time through the developer feeding opening 81A. According to the developer filling system of the present invention, therefore, a shutter closing mechanism 120 which will be described later causes the slide shutter 84 to automatically close the developer feeding opening 81A. The shutting closing mechanism 120 comprises the projection 88 projected from the rear side of the slide shutter 84 and a recess 121 provided in the developing unit 13. When the front cover 1A of the apparatus body 1 is opened in a direction L to detach the developer cartridge 80 from the developing unit 13, as shown in FIG. 20, the slide shutter 84 leaning on the front cover 1A, as shown by a two-dot and dash line, is swung round rods 86 in a direction M. It is thus supported horizontally by a horizontal support collar 122 projected from the top of the recess 121, as shown by a solid line. The projection 88 on the rear side of the Slide shutter 84 enters this time into the recess 121. When the developer cartridge 80 is then pulled in a direction N, as shown in FIG. 21, the projection 88 on the rear side of the slide shutter 84 is hooked by the front end face of the recess 121. The slide shutter 84 can thus be fixed. When the developer cartridge 80 is further pulled, it is moved to such a position that its developing feeding opening 81A can be closed by the slide shutter 84, while engaging its shutter guides with the guide grooves 87 of the slide shutter 84. Its support step 96 which serves also as the shutter stopper is thus struck against one of the rods 86 of the slide shutter 84, so that it can be fixed.

Figure 22:
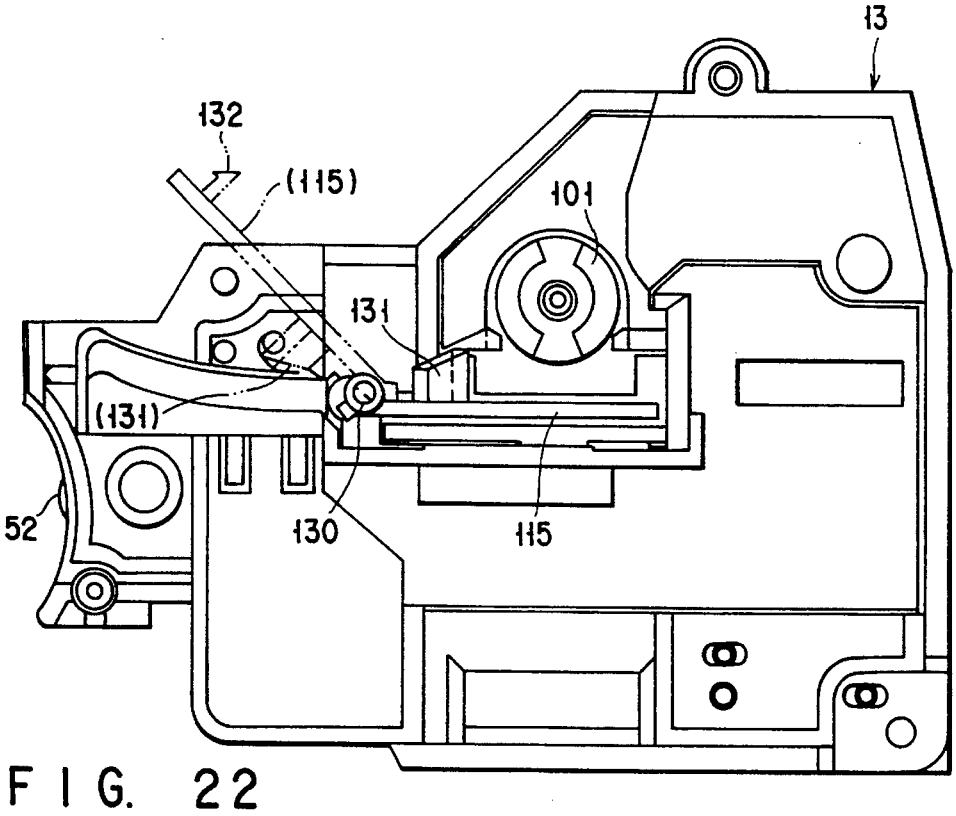
FIG. 22 shows a developer adding opening of the developing unit closed by a cap member just after the developer cartridge is detached from the developing unit.

When the empty developer cartridge 80 is detached, the developer feeding opening 112 is closed by the cap 115 arranged adjacent to the developer cartridge holder section 110, as shown in FIG. 22. This enables only the toner cartridge 75 to be set in the developing unit 13. More specifically, a setting guide 131 is projected from the top of the cap 115, which has been swung round a rod 130 to close the developer feeding opening 112, and the toner cartridge 75 can be guided on the top of the cap 115 by the setting guide 131. It can thus be set in the developing unit 13, as shown in FIG. 4.

When the developer feeding opening 112 is closed by the cap 115, the developer cartridge 80 cannot be set in the developing unit 13 because it is stopped by the setting guide 131. Further, the cap 115 is provided with engaging claws 132, which can engage with the rim portion of the developer feeding opening 112 when the cap 115 is closed. The cap 115 can be thus kept closed and it cannot be mistakenly opened.

After two-component developer D comprising toner T and carrier C is filled in the developer-filled section 51 when the apparatus is to be used for the first time, therefore, the adding of only toner T is made possible. This enables an excellent developing operation to be more reliably attained and kept.

According to the present invention as described above, an image forming apparatus comprises a developing means having a section in which developer is filled, a first supply opening provided in the developing means and serving to detachably support a developer cartridge in which developer comprising toner and carrier is stored and also to allow developer to be supplied from the developer cartridge into the developer-filled section through it, a second supply opening provided in the developing means independently of the first one and serving to detachably support a toner cartridge in which toner is stored and also to allow toner to be supplied from the toner cartridge into the developer-filled section through it, and means arranged under the first and second supply openings and serving to carry developer or toner supplied through the first or second supply opening to the developer-filled section of the developing means. The developer cartridge can be more easily and quickly set into the developing unit from one side thereof in the same manner as seen in the case of the toner cartridge. Therefore, developer or toner supply can be attained without detaching the developing unit from the image forming apparatus. This increases the workability of the apparatus to a greater extent.

Further, the developer supply opening is formed independently of the toner supply opening. Therefore, the time during which the filling of developer is finished can be made shorter.

Furthermore, the developer wrapping case is made into a cartridge. Therefore, the number of wrapping materials can be decreased. In addition, the developer cartridge makes it easier to operate the apparatus.

Still further, vibration is added to the developer cartridge, associating with the rotating member by which the toner adding member of the toner adding unit is driven. Therefore, no developer can be left in the developer cartridge used up.

Still further, the developer cartridge used up can be again used as the waste toner collecting case. This makes it unnecessary to use a case exclusively used to collect waste toner. The copying cost can be made lower, accordingly.

Still further, When the developer filling opening is closed by the cap after developer is filled in the developer-filled section through the developer cartridge, only the toner cartridge is allowed to be set in the developing unit. This prevents a new developer cartridge to be again mistakenly set in the developing unit. The adding of only toner can be thus made possible to thereby more reliably attain and keep a more excellent copying operation.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus wherein a developer, including a toner and a carrier, is charged from a developer cartridge and a replenishment toner is supplied from a toner cartridge after charging of the developer, comprising:

developer receiving means for receiving the developer charged from the developer cartridge;

a first opening section, provided on the developer receiving means and having a first opening, for allowing the developer to be received into the developer receiving means from the developer cartridge;

first supporting means for detachably supporting the developer cartridge so as to set a charge port of the developer cartridge on the first opening section;

a second opening section, provided on the developer receiving means and having a second opening, for allowing the toner to be received into the developer receiving means from the toner cartridge;

second supporting means for detachably supporting the toner cartridge so as to set a supply port of the toner cartridge on the second opening section; and covering means, pivotally mounted on the first opening section and rotated between first and second positions, for allowing the first opening to be opened and preventing the toner cartridge from being mounted on the second supporting means when the covering means is set in the first position, and for covering the first opening and allowing the toner cartridge to be mounted on the second supporting means when the covering means is set in the second position.

2. An apparatus according to claim 1, further comprising:

means for applying a vibration to the developer cartridge when the developer cartridge is mounted on the first supporting means to charge the developer into the developer receiving means.

3. An apparatus according to claim 1, wherein the covering means includes a guiding section for guiding the developer cartridge to mount the developer cartridge on the first supporting means when the covering means is set in the first position.

4. An apparatus according to claim 1, wherein the covering means includes a preventing section for preventing the developer cartridge from being mounted on the first supporting means.

5. An apparatus according to claim 1, wherein the covering means includes a fixing section for fixing the covering means on the first opening section when the covering means is rotated from the first position to the second position and set in the second position.

6. A developer apparatus wherein a developer, including a toner and a carrier, is charged from a developer cartridge and a replenishment toner is supplied from a toner cartridge after charging of the developer, comprising:

a developer housing for receiving and storing the developer supplied from the developer cartridge;

a first inlet section, having a first opening and provided on the developer housing, for allowing the developer to be supplied from the developer cartridge to the developer housing;

a second inlet section, having a second opening and provided on the developer housing, for allowing the toner to be supplied from the toner cartridge;

supporting means, having the first inlet section and the second inlet section, for supporting one of the toner cartridge and the developer cartridge;

setting means for setting a developer supplying mode and a toner supplying mode; and means for preventing the supporting means from supporting the toner cartridge when the developer supplying mode is set by the setting means, and for preventing the supporting means from supporting the developer cartridge when the toner supplying mode is set by the setting means.

7. An apparatus according to claim 6, further comprising:

means for applying a vibration to the developer cartridge when the developer cartridge is mounted on a first inlet section to charge the developer into a developer housing.

* * * * *